US011008263B2

(12) United States Patent
Isert et al.

(10) Patent No.: US 11,008,263 B2
(45) Date of Patent: May 18, 2021

(54) REACTIVE BURNING RATE ACCELERATORS, SOLID ENERGETIC MATERIALS COMPRISING THE SAME, AND METHODS OF USING THE SAME

(71) Applicant: PURDUE RESEARCH FOUNDATION, West Lafayette, IN (US)

(72) Inventors: Sarah Isert, Abingdon, MD (US); Steven Forrest Son, West Lafayette, IN (US); Colin D. Lane, Odessa, FL (US); Ibrahim Emre Gunduz, Lincoln, NE (US)

(73) Assignee: Purdue Research Foundation, West Lafayette, IN (US)

( * ) Notice: Subject to any disclaimer, the term of this patent is extended or adjusted under 35 U.S.C. 154(b) by 517 days.

(21) Appl. No.: 15/423,877

(22) Filed: Feb. 3, 2017

(65) Prior Publication Data

US 2018/0022663 A1 Jan. 25, 2018

Related U.S. Application Data

(60) Provisional application No. 62/291,865, filed on Feb. 5, 2016.

(51) Int. Cl.
*C06B 45/14* (2006.01)
*C06B 43/00* (2006.01)

(52) U.S. Cl.
CPC ..... *C06B 45/14* (2013.01); *C06B 43/00* (2013.01)

(58) Field of Classification Search
None
See application file for complete search history.

(56) References Cited

U.S. PATENT DOCUMENTS

| | | | | |
|---|---|---|---|---|
| 6,342,272 | B1 * | 1/2002 | Halliwell | B05D 1/10 427/447 |
| 7,524,355 | B2 * | 4/2009 | Dreizin | C06B 21/0066 148/513 |
| 9,227,883 | B2 * | 1/2016 | Sippel | C06B 45/18 |
| 2010/0032064 | A1 * | 2/2010 | Dreizin | C06B 21/0066 149/37 |
| 2014/0034197 | A1 * | 2/2014 | Sippel | C06B 45/18 149/3 |

* cited by examiner

*Primary Examiner* — Aileen B Felton
(74) *Attorney, Agent, or Firm* — Hartman Global IP Law; Gary M. Hartman; Domenica N. S. Hartman

(57) ABSTRACT

A reactive burning rate accelerator is provided that is configured to be at least partially embedded in a solid energetic material and comprises at least one metallic component and at least one non-metallic component. The reactive burning rate accelerator is configured to ignite and combust to increase the mass burning rate of the solid energetic material. Also provided are solid energetic materials comprising the reactive burning accelerator and methods of manufacturing and using the same.

17 Claims, 12 Drawing Sheets

REACTIVE BURNING RATE ACCELERATORS, SOLID ENERGETIC MATERIALS COMPRISING THE SAME, AND METHODS OF USING THE SAME

CROSS REFERENCE TO RELATED APPLICATIONS

This application claims the benefit of U.S. Provisional Application No. 62/291,865, filed Feb. 5, 2016, the contents of which are incorporated herein by reference.

STATEMENT REGARDING FEDERALLY SPONSORED RESEARCH

This invention was made with government support under Contract No. FA9550-13-1-0004 awarded by the Air Force Office of Scientific Research, and under Contract No. 1147384 awarded by the National Science Foundation Graduate Fellowship Program. The government has certain rights in the invention.

BACKGROUND OF THE INVENTION

The present invention generally relates to solid propellants energetic materials and reactive burning rate accelerators for use therewith. The invention particularly relates to solid energetic materials comprising reactive burning rate accelerators, methods for their manufacture, and methods for their use.

Solid propellants commonly used in rockets and aircraft are used in forms referred to as propellant charge (grains) made up of a fuel and an oxidizer that causes the fuel to burn or otherwise decompose to produce a propellant gas. There are numerous factors which affect propellant performance, such as the propellant composition, its linear burning rate, its ambient temperature, combustion chamber pressure, and the like. A particularly important parameter that affects thrust of propellant grains, which are loaded into and burned directly in the combustion chamber of a rocket motor or engine, is the burning surface area, which greatly affects the mass rate of gas generation. The rate of generation of propulsive gases, other factors being equal, is proportional to the product of the propellant burning rate and the burning surface area. Tailoring solid propellant burning rates is a perpetual goal of solid propellant designers. Traditional approaches to tailoring propellant burning rates include modifying the particle size of the oxidizer and adding catalysts to the propellant. However, these methods only increase the propellant burning rate up to a certain point and can diminish propellant performance.

The addition of burning rate accelerators (or simply accelerators) to propellants has been used to improve and tailor burning rates. For example, inert metallic staples, whiskers, foils, and wires have been cast into the grain of propellants in order to increase propellant thermal conductivity and provide a low-resistance thermal path for heat flow from the flame into the propellant. Metallic accelerators have been used in various thicknesses, lengths, and shapes. Relatively short staples, whiskers, fibers, and the like are commonly randomly distributed throughout solid propellant grains. Wires are typically distributed as long strands embedded axially in solid propellant grains. Wired propellants in particular have been used in thousands of fielded sounding rockets and tactical missiles.

Inert metallic accelerators cause local preheating that results in locally increased burning rates and changes the burning surface profile to cause increased overall mass burning rate. However, inert metallic accelerators, and wires in particular, can sometimes act as heat sinks and decrease propellant burning rate and performance. As such, inert metallic accelerators generally increase burning rate only if the volume and weight fractions are adequately low. Consequently, such accelerators provide only a limited range of burning rate augmentation.

When a propellant grain includes inert metallic wires as an accelerator, the embedded wires cause an increase in surface area as the burning surface transforms from a nominally flat surface to a cone-like surface. Generally, the cone-like burning surface forms when multiple burning rates are present, and the fastest burning rate dominates the process. At steady-state, the constant thrust profile of an end-burner motor may be retained but the mass burning rate of the propellant will likely be higher. Commonly used inert wires include copper, silver, silver alloys, steel, tungsten, aluminum, magnesium, nickel, molybdenum, brass, platinum, and relatively low melting point metals plated with higher melting point metals.

The degree of burning rate enhancement from embedded wire accelerators depends on wire thermal diffusivity and melting temperature. For long wires, burning rate generally increases with increasing wire diameter up to a certain point, after which it decreases as thermal sink losses become more significant. Cross-sectional shape of wire accelerators has been reported to weakly affect burning rate as long as the length-to-diameter ratio is relatively high.

Despite the advantages of inert metallic burning rate accelerators, several factors limit their performance. For example, embedded wires may cause an overall performance decrease if the wire acts as a heat sink to the propellant. In addition, casting long, straight axial wires can be difficult, and non-uniform wire spacing may cause unintended thrust profiles as the propellants regress. In regards to fibers, whiskers, staples, etc., poor bonding between the accelerators and the propellant may cause grain cracking, and thermal cycling may cause de-bonding between the grain and fibers.

Non-metallic burning rate accelerators have also been attempted. For example, propellant grains comprising embedded optical fibers have been used in laser-assisted combustion, and Kevlar® fibers have been observed to act as flame holders and can affect the burning rate.

Self-alloying systems such as nickel/aluminum foils or aluminum-palladium core-shell wires (commercially available under the trademark Pyrofuze® from Pyrofuze Corp.) have been proposed for use in propellant grains. Self-alloying wires may increase a propellant's burning rate; however, self-alloying wires may decrease the specific impulse of the propellant considerably compared to propellant grains with aluminum as an accelerator, and even slightly compared to propellants without an accelerator. Specific impulse is the total impulse (or change in momentum) delivered per unit of propellant consumed and is dimensionally equivalent to the generated thrust divided by the propellant flow rate.

Therefore, other approaches are needed to tailor burning rates of propellants over a wider range than conventionally possible in order to enable the design of currently unattainable rocket solid propellant grain configurations.

BRIEF DESCRIPTION OF THE INVENTION

The present invention provides reactive burning rate accelerators suitable for improving mass burning rates of solid energetic materials, solid energetic materials comprising the same, and methods of using the same.

According to another aspect of the invention, a reactive burning rate accelerator is provided that is configured to be at least partially embedded in a body comprising a solid energetic material and comprises at least one metallic component and at least one non-metallic component. The reactive burning rate accelerator is configured to ignite and combust to increase the mass burning rate of the solid energetic material.

According to one aspect of the invention, a body formed of a solid energetic material is provided that includes a reactive burning rate accelerator at least partially embedded in the body. The reactive burning rate accelerator comprises a mechanically-activated material that is at least partially formed of micron-sized particles comprising nano-thickness layers of at least one metallic component and at least one non-metallic component. The reactive burning rate accelerator is configured to ignite and combust to increase the mass burning rate of the solid energetic material.

According to another aspect of the invention, a method of combusting a solid energetic material is provided that includes igniting a reactive burning rate accelerator embedded in a body formed of the energetic material. The reactive burning rate accelerator comprises a material that is at least partially formed of micron-sized particles comprising nano-thickness layers of at least one metallic component and at least one non-metallic component. The reactive burning rate accelerator is configured to ignite and combust to increase the mass burning rate of the solid energetic material.

Technical effects of reactive burning rate accelerators of types described above preferably include the ability to improve the mass burning rate and specific impulse of solid energetic materials, such as solid propellants, relative to conventional burning rate accelerators.

Other aspects and advantages of this invention will be further appreciated from the following detailed description.

BRIEF DESCRIPTION OF THE DRAWINGS

FIG. 1 includes a single reactive burning rate accelerator in the energetic material and FIG. 2 includes multiple reactive burning rate accelerators in the energetic material.

DETAILED DESCRIPTION OF THE INVENTION

The present invention generally provides reactive burning rate accelerators (reactive accelerators), for example, foils, wires, etc., in contact with and/or embedded into a solid energetic material, such as but not limited to explosives, propellants, pyrotechnics, and fuels, in order to increase the propellant mass burning rate. Reactive accelerators are defined herein as accelerators that exothermically react, combust, and burn by themselves when ignited and produce a source of heat, that is, once ignited at an ignition temperature, the temperature of the reactive accelerator increases to a combustion temperature at which it combusts and provides heat to the propellant to ignite it. In contrast, other accelerators discussed herein are inert, and while they may exothermically self-alloy, they do not exothermically react, combust, and burn by themselves when ignited. Once activated, the combustion of the reactive accelerators ignites the energetic material with which it is in contact, increasing the mass burning rate of the energetic material by exposing more burning surface area.

Preferably, the reactive accelerators not only increase the energetic material's burning rate, but are also an active participant in the material's combustion, adding gas pressure to the system and preferably leaving little or no condensed phase materials (referred to herein as slag), as would commonly result from inert and self-alloying wires/foil accelerators. Preferably, any reaction products, combustion products, or other condensed phase materials remaining after the combustion of the reactive accelerators have diameters (or maximum lengths, widths, and depths) of less than one millimeter, preferably up to 200 micrometers, and more preferably up to 10 micrometers (e.g., 0.1 nm-10 μm). For convenience, the reactive accelerators will be primarily discussed herein in reference to solid propellants. However, the reactive accelerators may be used for various applications, including increasing the burning rate of a wide variety of explosives, propellants, pyrotechnics, and fuels. As a nonlimiting example, the reactive accelerators may be used as a low temperature gas generator of the types commonly used in, for example, automotive safety devices, such as but not limited to airbags.

Figure 1:
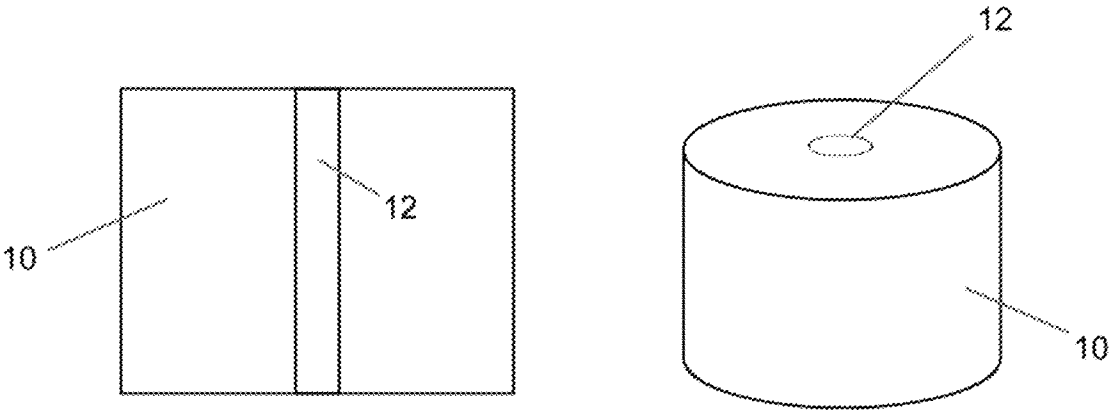
FIGS. 1 and 2 each include cross-sectional and perspective views that schematically represent reactive burning rate accelerators embedded in solid energetic material bodies in accordance with certain nonlimiting aspects of the invention.
Figure 2:
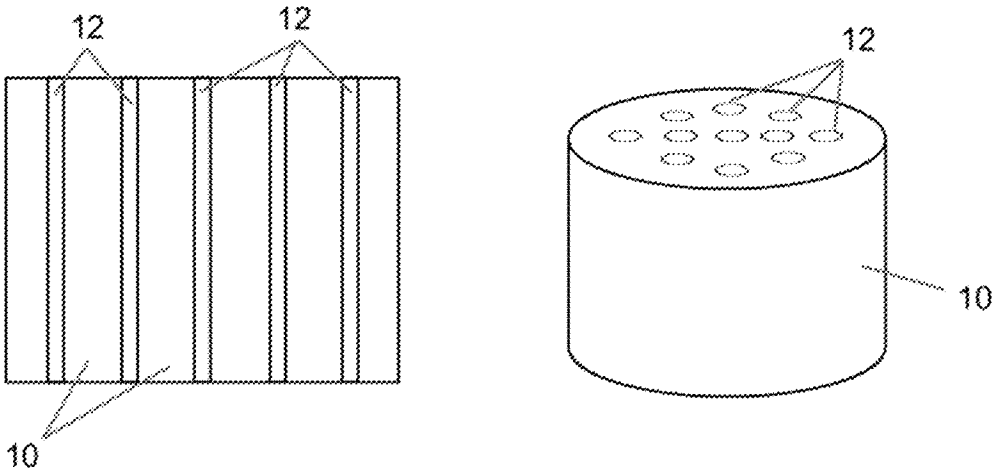
Figure 3:
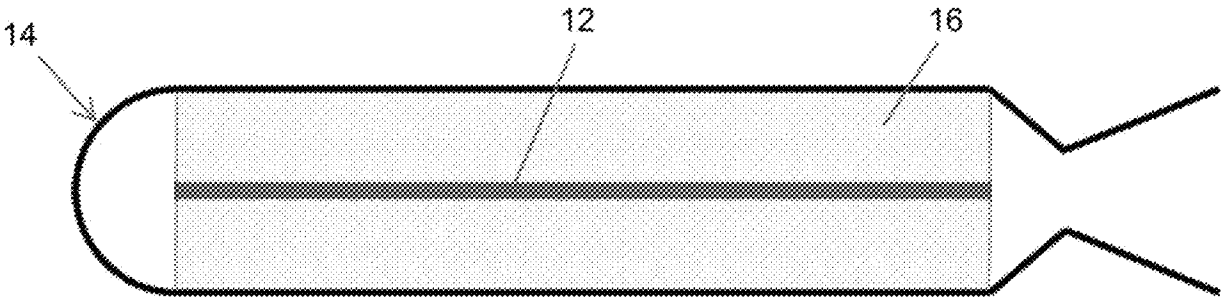
FIG. 3 schematically represents a cross-sectional view of a nonlimiting embodiment of a rocket comprising a solid propellant grain having a reactive burning rate accelerator embedded in the propellant.

The reactive accelerators may be added to a propellant grain in various configurations or patterns and may have various cross-sectional shapes and lengths. For example, foil- or wire-shaped accelerators may be oriented axially through the center of a propellant grain, randomly mixed into a propellant grain, or embedded in a propellant grain according to a desired pattern. FIGS. 1 and 2 schematically represent reactive accelerators 12 embedded in solid energetic material bodies 10. FIG. 1 includes a single reactive accelerator 12 and FIG. 2 includes multiple reactive accelerators 12. FIG. 3 schematically represents a nonlimiting rocket 14 comprising solid propellant grain 16 having a single reactive accelerator 12 oriented axially through the center of the grain 16.

Propellants comprising the reactive accelerators may be formed by various means, including but not limited to those conventionally used for inert and self-alloying accelerators. For example, one or more reactive accelerators may be cast in a propellant grain, or may be formed/inserted into a propellant grain with a three-dimensional (3-D) printing process. The 3-D printing process can either be accomplished by sequential printing of the propellant and the reactive accelerator, or by printing of the propellant to encapsulate an already fabricated reactive accelerator, into the final desired geometry. The reactive accelerators described herein may be used with any suitable propellant, such as but not limited to non-aluminized ammonium perchlorate/hydroxyl-terminated polybutadiene (AP/HTPB) composite propellants as discussed in the investigations below, as well as other solid propellants, including but not limited to composite solid propellants, double-base solid propellants, and composite double-base solid propellants.

The reactive accelerator may have various compositions. According to one nonlimiting embodiment of the invention, a reactive accelerator comprises at least one metallic component and at least one non-metallic component. Preferably, the reactive accelerator is mechanically-activated, that is, the components of the accelerator are combined mechanically using a technique such as, but not limited to, arrested reactive milling, to preferably result in micron-sized particles formed of nano-thickness layers of the components. As used herein, the term micro-sized particles denote particles having a diameter (or maximum length, height, and width) of about 1 to 999 micrometers, and more preferably about 10 to 50 micrometers, and the term nano-thickness layers denote layers of a layer having at least one dimension of less than one micrometer, and preferably up to 200 nanometers, and more preferably up to 100 nanometers, e.g., 0.1-100 nm.

Nonlimiting examples of mechanical-activation processes are disclosed in U.S. Patent Application Serial No. 2010/0032064 to Dreizin et al. and U.S. Pat. No. 9,227,883 to Sippel et al. In such processes, the fineness (thickness) of the layers generally provides the mechanically-activated material with a high reactivity. In contrast, conventional milling of the components to micron-sized particles generally would not produce particles formed of multiple components. Therefore, the components may have relatively long diffusion distances (on the order of microns rather than nanometers), yielding slower reaction times and less vigorous reactions. Conventionally produced nano-sized particles (that is, particles having a diameter (or maximum length, height, and width) of about 10 to 200 nanometers) may have diffusion distances similar to micron-sized mechanically-activated particles, but such nano-sized particles can be difficult to handle as they are very reactive. With the mechanically-activated materials, the particles have nano-thickness layers (features) that have short diffusion distances, but the particles themselves are micron-sized and therefore are likely to be more stable and safer to handle than nano-sized particles.

The reactive accelerator may include the at least one metallic component and at least one non-metallic component in various amounts, and may consist essentially of the metallic and non-metallic components (perhaps with incidental impurities) or may comprise additional components. Suitable materials may comprise a metallic component and a non-metallic component that in combination can self-react exothermically, that is, doesn't require an external oxidizer, and that once ignited locally, can continue to react until substantially all of the material combusts and is consumed and preferably produces a gas. Suitable non-metallic components may include, but are not limited to, materials comprising various oxides, nitrides, chlorides, carbides, and fluorides that are capable of being exothermically reduced with a corresponding metallic component. Such materials may be contained in polymeric materials. It is foreseeable that the MA reactive accelerators may comprise particles that consist of only one metallic component and one non-metallic component (perhaps with incidental impurities).

For example, one nonlimiting reactive accelerator suitable for use in solid propellants is a mechanically-activated (MA) aluminum-rich aluminum/polytetrafluoroethylene (Al/PTFE) accelerator, wherein the manufacturing process results in the accelerator comprising nanoscale features (e.g., nano-thickness layers within individual micron-sized particles). Suitable compositions of the Al/PTFE accelerator may include between 50 to 90 wt. % Al with the remainder being PTFE. Combustion products of the accelerator include relatively small (for example, less than about 10 micrometers in diameter) aluminum droplets and carbon, which can burn to increase the gas temperature and gas volume of the system. It is believed that the closer the percentages are to stoichiometric combustion, the more reactive the particles will be. Additionally, the burning rate of the accelerators may change as the composition changes, leading to an ability to tailor the burning rate of the propellant. Another exemplary composition for the reactive accelerator includes an aluminum/poly(carbon monofluoride) (Al/PMF) accelerator comprising between 70 to 90 wt. % Al, the remainder being poly(carbon monofluoride) (PMF). Similar to PTFE, PMF contains fluorine which is a powerful oxidizer, and provides exothermic heat generation when reacted with a metal, in this instance, aluminum.

The reactive accelerators described herein are believed to increase the efficiency of propellants as compared to inert and self-alloying accelerators. By using reactive accelerators in a propellant grain, the propellant ignition rate may be significantly increased as the flame front along the reactive accelerator propagates at an increased rate compared to the flame front of a propellant that does not include an accelerator, or even a propellant grain having an inert or self-alloying accelerator. Igniting the propellant at the flame front along the reactive accelerator causes the propellant to regress away from the accelerator as well as in the bulk axial direction of the overall propellant combustion. This causes an increase in surface area of the propellant that is exposed near the flame front which results in an overall increase in the mass burning rate. Furthermore, reaction products (for example, aluminum and carbon) are formed from the combustion of the reactive accelerators. These products may oxidize with propellant combustion products and increase the temperature of the combustion gases. In addition, the products may include significant amounts of gas that is released into the system. Because the reactive accelerators contribute to the energy and gas production of the propellant, the specific impulse of the propellant may be improved compared to propellants that do not comprise burning rate accelerators, or even compared to propellant grains having an inert or self-alloying accelerator.

In addition, inert and self-alloying wire/foil accelerators often deposit slag post-combustion that may increase two-phase flow losses of propellants. In contrast, preferred reactive accelerators of the present invention preferably burn completely and leave little or no slag or other left over materials. As such, the reactive accelerators may result in a decrease in slag production compared to inert and self-alloying wires/foil accelerators.

Reactive accelerators as described herein are believed to be well suited for use in solid propellants due to the high burning rate tailorability and their participation in propellant combustion. It is foreseeable that the overall mass burning rate of a propellant may be prescribed by the type of reactive accelerator used and the number and location of the accelerators. It is believed that adding reactive accelerators to propellant grains has the potential to create more efficient rockets as center perforations (that is, cavities provided within the grain to increase surface area) could be created in situ rather than cast into the propellant as is customary. This would result in dramatically increased propellant loading for the same overall rocket volume. Additionally, the addition of reactive accelerators into rocket solid propellant grains may allow for increased tailorability of solid rocket ballistics. Tailoring of the mass burning rate may be accomplished over a wide range by, for example, adjusting the ratio of the metallic and non-metallic components in the reactive accelerator, modifying the mechanical activation conditions, considering other inclusion materials or metals, etc.

Nonlimiting embodiments of the invention will now be described in reference to experimental investigations leading up to the invention. The following investigations examined the burning rates of exothermically alloying nickel/aluminum foils, Pyrofuze® wires, and pressed foils made from mechanically-activated aluminum/polytetrafluoroethylene (Al/PTFE). The observed burning rates were compared to propellant grains comprising embedded inert copper wires.

For the investigations described herein, non-aluminized ammonium perchlorate/hydroxyl-terminated polybutadiene (AP/HTPB) composite propellants with 80 wt. % solids loading and a 1:1 bimodal oxidizer size distribution with 400 micrometer coarse AP (Firefox Enterprises) and 20 micrometer fine AP (ATK) were used as solid propellants. The propellants included R45-M prepolymer (Firefox Enterprises) with Tepanol HX-878 bonding agent (3M Corporation) as a binder, icodecyl pelargonate plasticizer (RCS RMC), and Desmodur E744 curative (Bayer Corporation). The propellants were hand-mixed, degassed for ten minutes under vacuum, and cast into molds.

Four metallic fibers were investigated including copper wire, nickel/aluminum foils, Pyrofuze® wire, and Al/PTFE foils. The 20 gage copper wires (0.81 mm diameter) had a round cross-section. The nickel/aluminum nanofoil (NF80, Indium Corporation) were 80 micrometers thick and consisted of nanoscale alternating layers of nickel and aluminum. When this type of foil is ignited, it exothermically self-alloys. The cut foils were approximately 1 mm×80 μm×25.4 mm in size. The Pyrofuze® wire (0.007 inch diameter, Sigmund-Cohn Corporation) consisted of an inner aluminum core and an outer shell of 95 wt. % palladium/5 wt. % ruthenium. Once ignited, Pyrofuze® wire alloys exothermically. The approximate minimum ignition temperature is 650° C. and the alloying reaction temperature is about 2800° C.

Mechanically-activated Al/PTFE (70/30 wt. %) foil was prepared to have sieved particle diameters of between 25 and 75 micrometers. To create the foils, 0.82 g of material was remotely pressed on a Carver press (model NBS-400) at 34.5 MPa for 5 minutes in a square custom-built 25×25 mm die. The pressed foils were cut using a razor blade into 1 mm strands, resulting in 1 mm×1 mm×25.4 mm pressed Al/PTFE strands.

Figure 4:
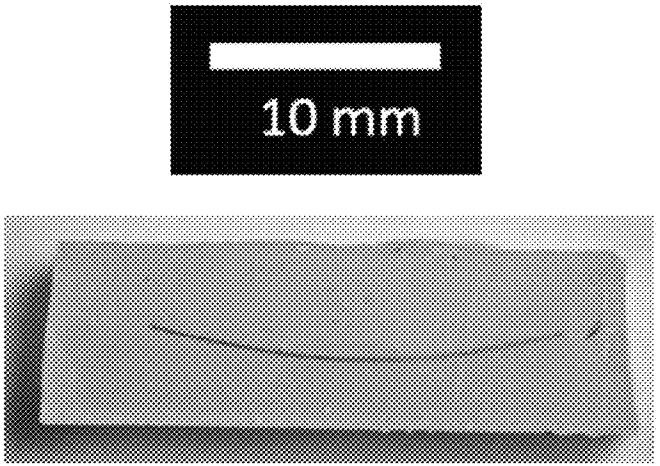
FIG. 4 includes two images representing a propellant grain with an embedded wire, including a schematic representation of a top view of the propellant (left), and an image showing an actual cast propellant with a Pyrofuze® wire visible through a polycarbonate window.
Figure 4:
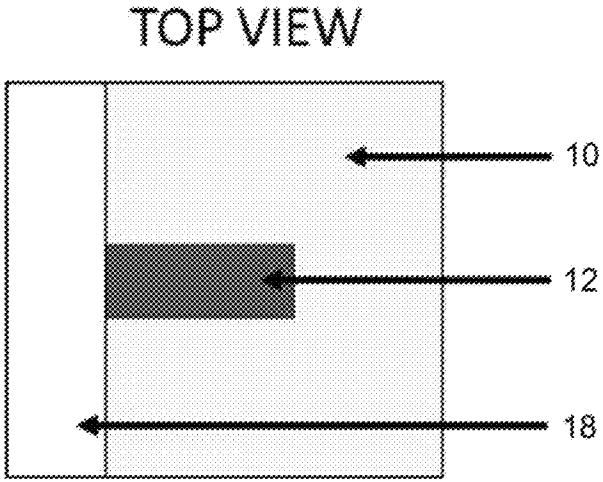

As it was desired to see how embedded wires affect the propellant surface, and as the AP/HTPB propellant was opaque, a windowed design was used. Although a window may slightly affect propellant burning rate, it beneficially allowed direct visualization of the burning surface. The propellants were cast in two-part molds. Polycarbonate windows were placed upright in the molds that were then filled half-way with propellant. The wire or foil was placed directly against the window. The mold was then filled completely with propellant, covering the wire. A diagram of a representative sample can be seen in FIG. 4 (left) comprising the solid propellant grain 10, reactive accelerator 12, and window 18, and an actual sample containing a Pyrofuze® wire can be seen in FIG. 4 (right).

Propellants were ignited with Nichrome wire and burned in a nitrogen-pressurized strand burner at pressures between 4.8 and 19.3 MPa. Multiple samples were burned at each pressure level and image data were collected using a high-speed camera operating at 2000-2500 fps. Propellant burning rates were determined from the videos. As the propellant burned, the polycarbonate window accumulated char. However, the window in front of the unburned propellant remained clear such that the regression of the propellant surface was readily visible and the propagation of the flame front could be tracked. For some tests, slag from the copper and Ni/Al wires was collected. Pressed Al/PTFE foils were also epoxide to a stand and ignited in air using a $CO_2$ laser.

Figure 5:
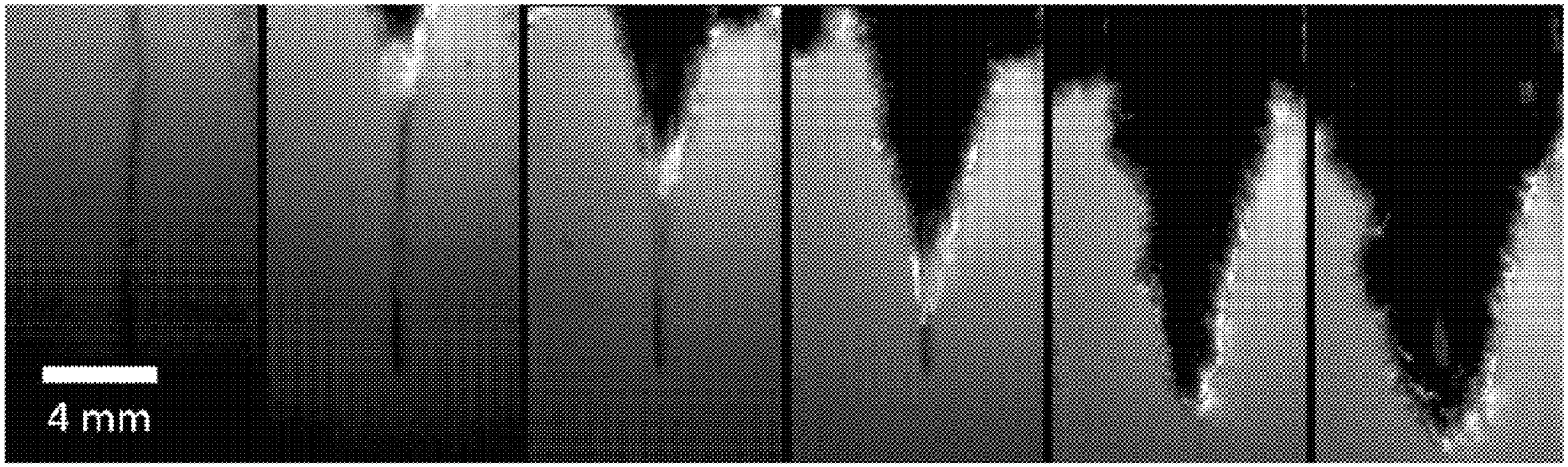
FIG. 5 includes a series of time lapsed images representing the combustion of a propellant grain having a copper wire therein at 13.8 MPa with 80 ms between frames (progressing left to right).

FIG. 5 is a series of time lapsed images representing an embedded copper wire propellant grain burning at 13.8 MPa. The wire is visible as a dark colored region through a center portion of the light colored propellant. A cone-shape cavity can be seen developing as the propellant burns. Though not visible in these images, there was a slight delay between the glowing wire being heated and the propellant igniting. The propellant burned axially as well as laterally from the wire surface. Remaining copper wires were often recovered post-test after the propellant had burned completely.

Figure 6:
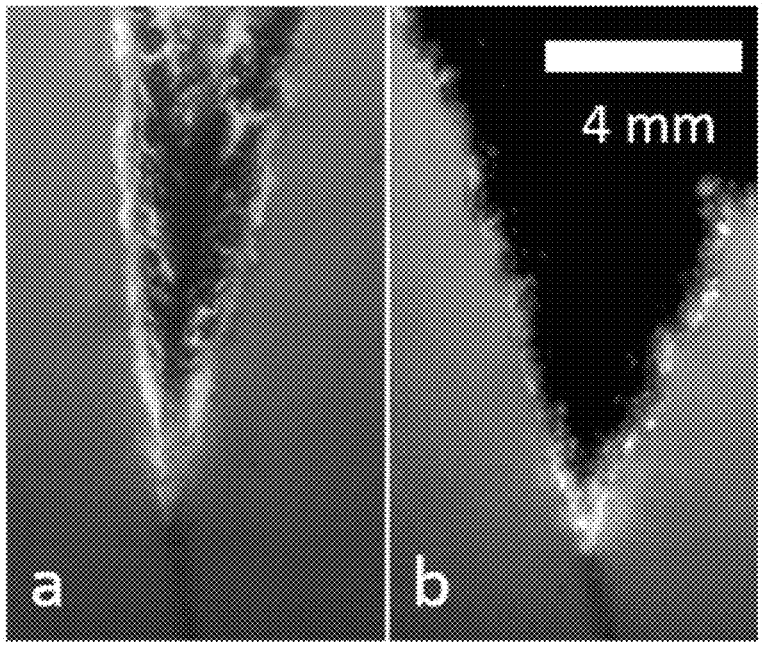
FIG. 6 includes two images representing a propellant grain having a copper wire therein and exhibiting a burning surface cone angle of about 4.8 MPa (image a, left) and 19.3 MPa (image b, right).
Figure 7:
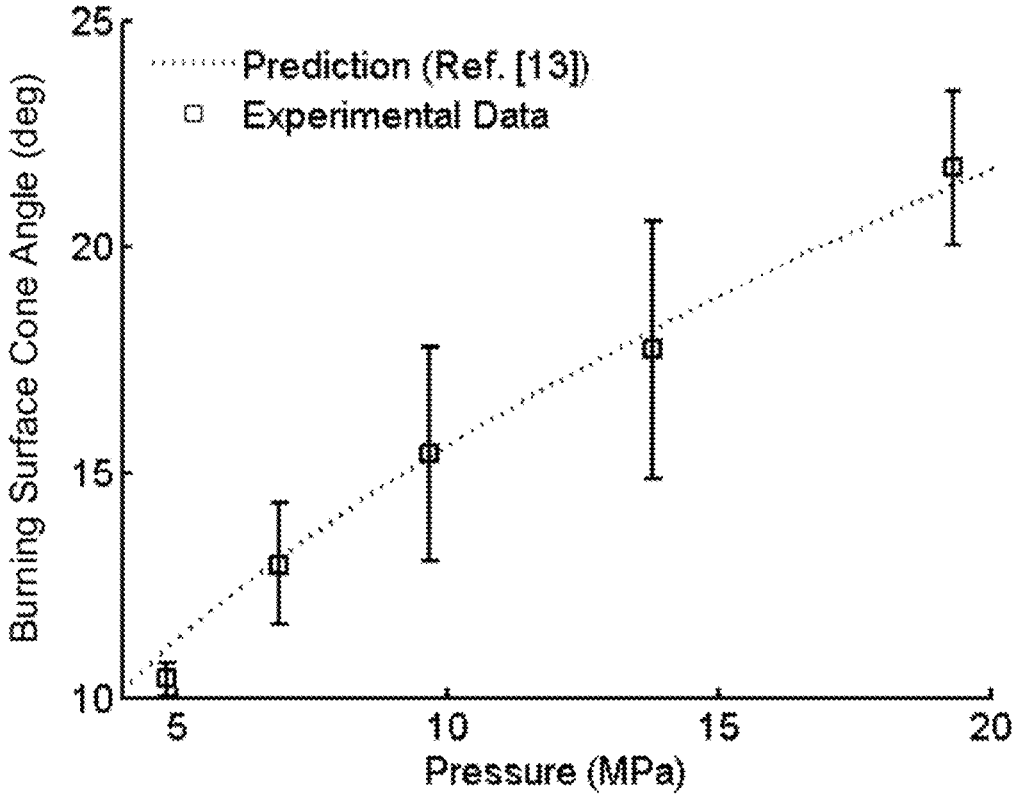
FIG. 7 is a graph representing changes in burning surface cone angle as a function of pressure for embedded copper wire propellant grains.

The ignition front of the burning copper wire propellant grain was observed to move at an average speed of 28.6±4.51 mm/s over all pressures investigated. The cone half-angle formed was believed to be $$\theta=\alpha \sin(r_{bo}/r_{be})$$

where $r_{bo}$ is the bulk propellant burning rate and $r_{be}$ is the enhanced burning rate at the tip of the cone. The half-angle at which the propellant burned away from the wire changed from about 10° at 4.8 MPa to about 21° at 19.3 MPa, very similar to the half-angles calculated from prediction models. The change in cone angle was believed to be a result of the flame front of the propellant near the wire traveling at a constant velocity regardless of pressure while the bulk propellant burning rate increased with pressure. Consequently, at higher pressures the cone angle was larger because the propellant was regressing faster away from its ignition point. The change in cone angle can be seen visually for propellants at 4.8 and 19.3 MPa in FIG. 6 (image a and b, respectively) and graphically in FIG. 7.

Figure 8:
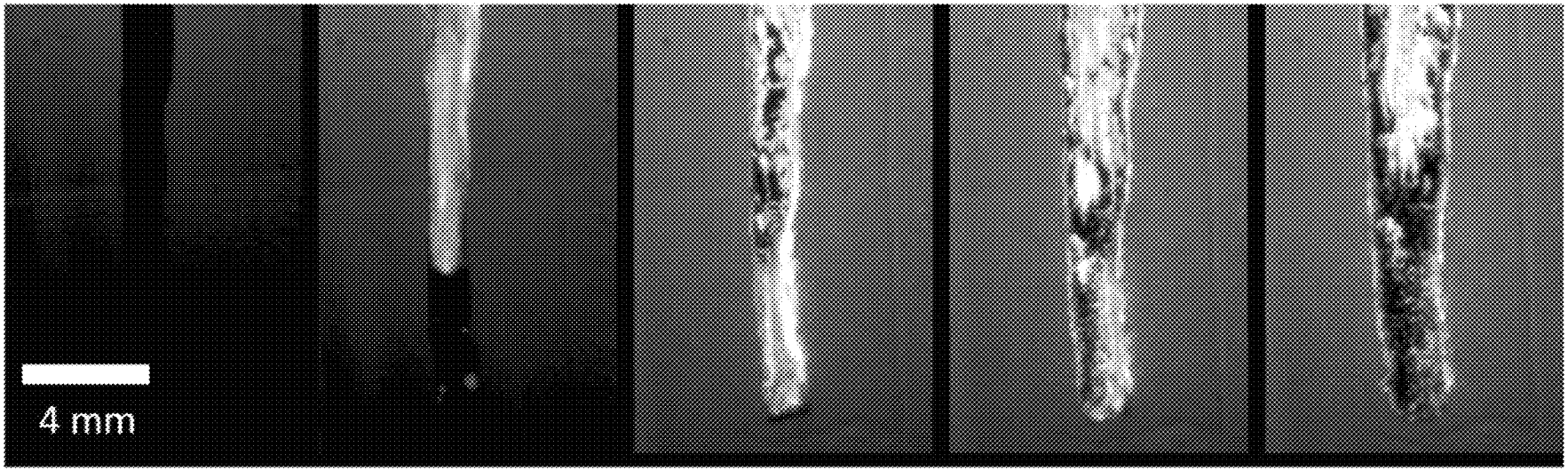
FIG. 8 includes a series of time lapsed images representing the combustion of a nickel/aluminum foil propellant grain at 13.8 MPa with 20 ms between frames (progressing left to right). The propellant ignited within 20 ms of first contact with the hot wire.
Figure 12:
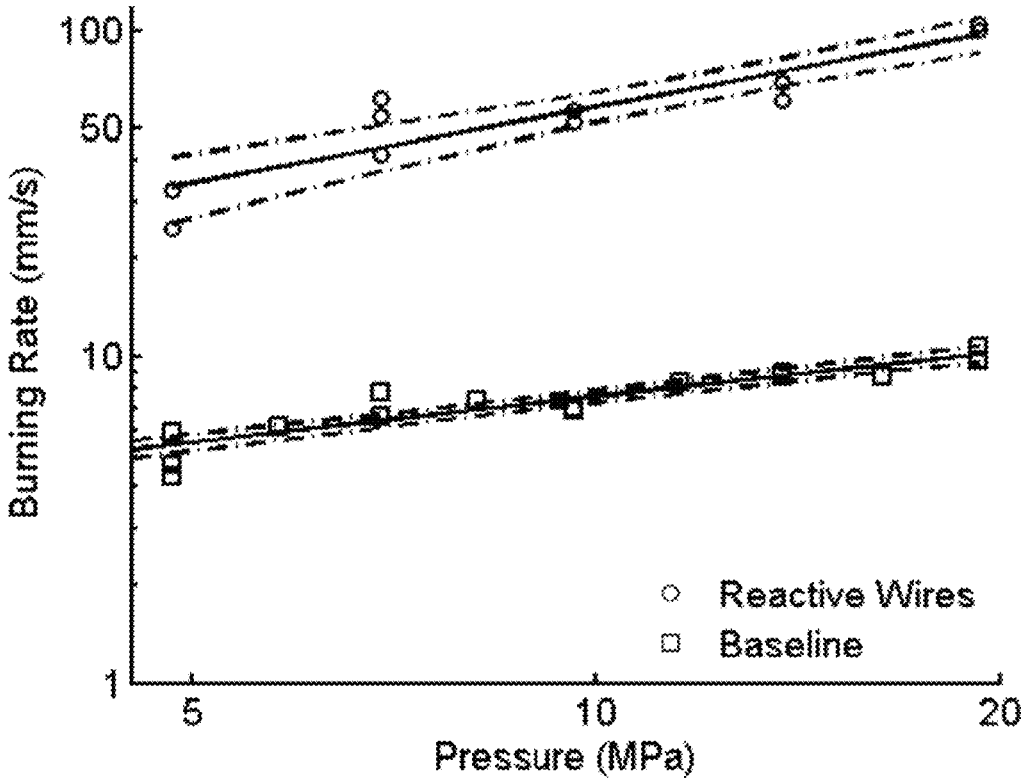
FIG. 12 is a graph representing changes in the burning rate of propellants near Al/PTFE foils as a function of pressure. Baseline propellant burning rate with 95% confidence bands is also shown.

Nickel/aluminum (Ni/Al) nanoscale foil is an exothermically self-alloying material that was chosen as a good contrast to inert and gas-producing reactive wires. FIG. 8 is a series of time lapsed images representing a typical burn progression of a Ni/Al foil propellant grain observed during the investigations. The foil is visible as a dark colored region through a center portion of the light colored propellant. The self-alloying reaction proceeded quickly and ignited the propellant as the alloying reaction passed by. After ignition, the propellant burned at the pressure-dependent bulk propellant rate (FIG. 12). Large pieces of remaining alloyed product from the Ni/Al foils were frequently found post-burn.

The Ni/Al foils reacted at 5900±700 mm/s over all pressures investigated. The burning rate is stated by the product literature as 6500-8000 mm/s. The decrease in the burning rate observed was believed to be due to heat loss into the window and the surrounding propellant. The reaction velocity of such foils can be tailored and is expected to change with foil bilayer thickness. Unlike the copper-wired propellant grains, the burning surface angles (cone half-angles) of the Ni/Al propellant grains were constant and relatively small (2.91±0.64°) though slightly larger than predicted. The difference between the observed and theoretical angles was believed to be due to factors such as augmented heating and the foils not being perfectly perpendicular.

NASA CEA calculations were performed for a rocket with a propellant grain comprising about 70 wt. % AP, 14 wt. % HTPB, 8 wt. % Al, and 8 wt. % Ni (i.e., Ni/Al foil accelerator). The vacuum specific impulse was decreased by about 8% compared to an equivalent propellant grain with 16 wt. % Al (i.e., Al foil accelerator). The nickel and aluminum alloying temperature was predicted to be about 1800 K, which is lower than aluminum combustion temperatures, and the products were higher in molecular weight, decreasing the specific impulse. The Ni/Al propellant grain was calculated to have a specific impulse that was 1.6% lower than a non-aluminized propellant grain containing about 86 wt. % AP and 14 wt. % HTPB (i.e., no accelerator).

Figure 9:
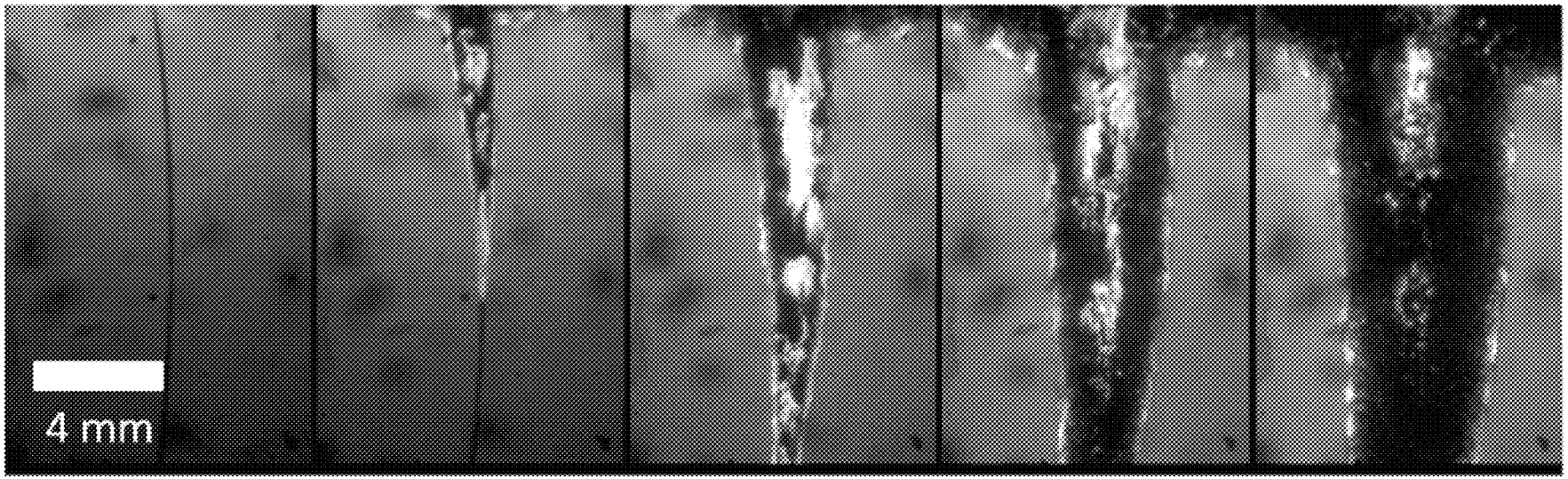
FIG. 9 includes a series of time lapsed images representing the combustion of a Pyrofuze® wire propellant grain at 13.8 MPa with 40 ms between frames (progressing left to right).

Pyrofuze® wire is widely used in industry to ignite energetic materials, including explosives, propellants, and pyrotechnics. During the investigations, the self-alloying propagation speed was measured to be 85.3±13 2 mm/s inside the propellant at the tested pressures compared to a reported value of 200 mm/s at 1 atm and a measured value of 330±25 mm/s at 1 atm. Again, it is believed that these differences were due to heat loss to the surrounding propellant and window. FIG. 9 is a series of time lapsed images representing a typical burn progression of a Pyrofuze® wire propellant grain observed during the investigations. The wire is visible as a relatively thin, dark-colored region through a center portion of the light-colored propellant. The propellant burning surface angle was constant at 3.98±0.64°, which was larger than the theoretical value. The increased heat transfer from the hot wire may explain why the cone angles were similar between the Pyrofuze® wire and Ni/Al foil propellant grains even though the enhanced burning rates were an order of magnitude different.

Figure 10:
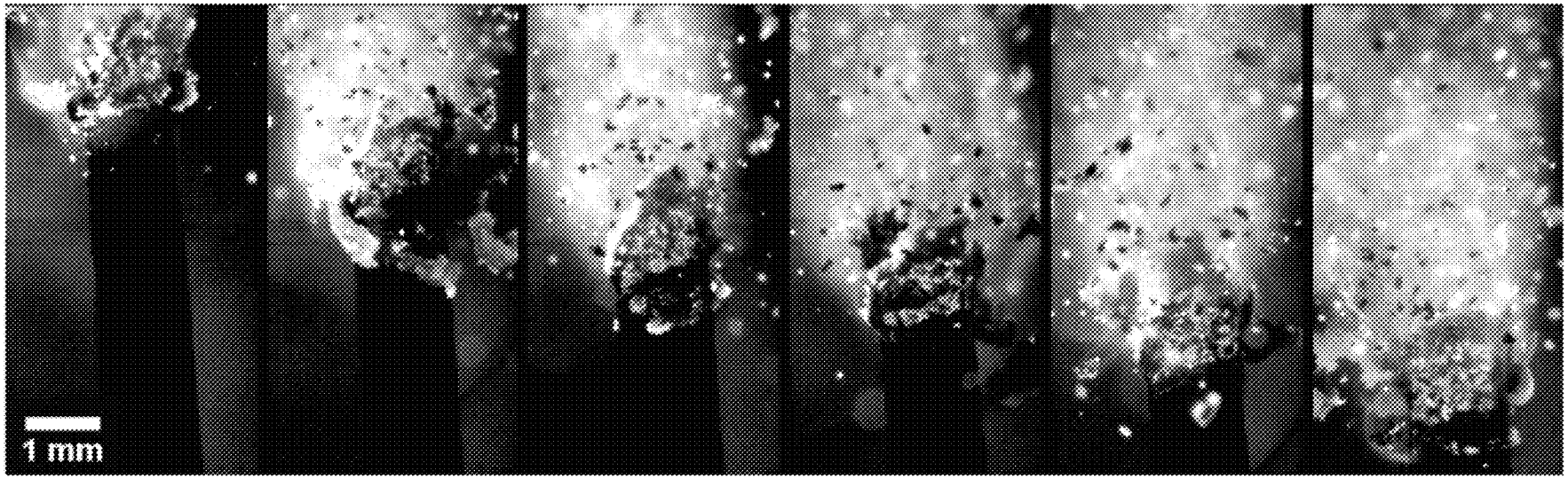
FIG. 10 includes a series of time lapsed images representing combustion of a freestanding aluminum/polytetrafluoroethylene (Al/PTFE) strand burning at 1 atm with 76 ms between frames (progressing left to right).
Figure 11:
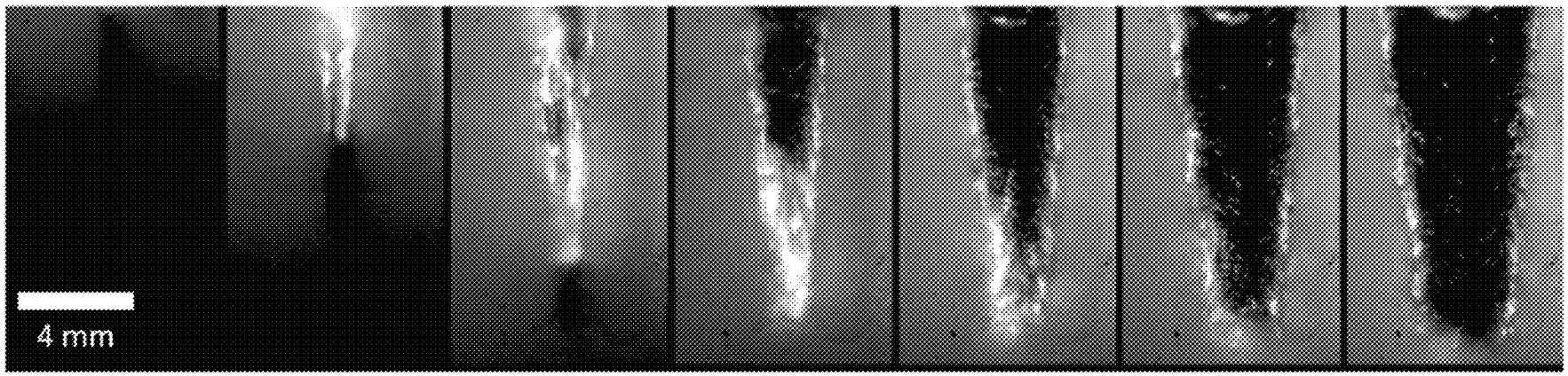
FIG. 11 includes a series of time lapsed images representing combustion of a Al/PTFE foil propellant grain at 13.8 MPa with 80 ms between frames (progressing left to right). A flame appears above the reacting foil.

At 1 atm, Al/PTFE foils readily burn independently and produce small particles. FIG. 10 is a series of time lapsed images representing a burn progression of a free-standing Al/PTFE foil observed during the investigations. The foil is visible as a dark-colored region in the images and smaller particles can be seen near the flame at an uppermost portion of the foil. The burning rate was measured to be approximately 20 mm/s. These foils were also placed in propellant grains and studied. FIG. 11 is a series of time lapsed images representing a burn progression of a Al/PTFE foil propellant observed during the investigations. The foil is visible as a dark-colored region through a center portion of the light-colored propellant. The foil was observed as burning independently as well as igniting the propellant. As pressure increased, no substantial change in the cone angle was observed. It is believed that this was a result of the foil burning rate increasing with pressure. The propellant ignited shortly after the foil burning surface passed by.

The burning rate of the propellant near the Al/PTFE foils depended on pressure, as represented in FIG. 12, as compared to a baseline propellant (without an accelerator) burning rate for reference. As pressure increased from 4.8 to 19.3 MPa, the enhanced burning rate near the Al/PTFE foils increased from six to ten times the burning rate of the bulk propellant. It is believed that the burning rate changes with pressure may have been due to changes in aluminum-fluorine reaction rates as pressure increased. The gasification of PTFE inside aluminum particles, as well as heating resulting in expansion, may cause pressures that break the aluminum apart during combustion (micro explosions). The aluminum particles produced from these types of materials are believed to be less than 10 microns in diameter when included in propellants, resulting in kinetically-limited combustion and stronger pressure sensitivity.

The investigations indicated that the Al/PTFE foil increased the propellant burning rate, as well as increased the propellant specific impulse. As an illustration, the copper, Ni/Al, and Pyrofuze® wires and foils may be compared (to some extent) to catalysts in that they aid in combustion of the propellants but do not significantly participate reactively and remain as slag after the bulk propellant is consumed. On the other hand, aluminum (from the aluminum-rich MA Al/PTFE wire) contributes as a fuel in propellants to increase the specific impulse by increasing the combustion gas temperature.

It is believed that a propellant grain having an Al/PTFE accelerator may be locally more fuel-rich than a similar propellant grain with dispersed fuel. The PTFE may add some amount of fluorination to assist in the aluminum combustion. Additionally, the condensed phase products (slag) are predicted to be smaller than those of the other wires, which could result in lower two-phase flow losses. The mixture ratio of Al and PTFE could be varied to specifically tailor the enhanced burning rate. Further, milling parameters could be adjusted to change the foil burning rate. This gives the enhanced burning rates significant variability. Other similar mechanically-activated systems could also be considered.

Figure 13:
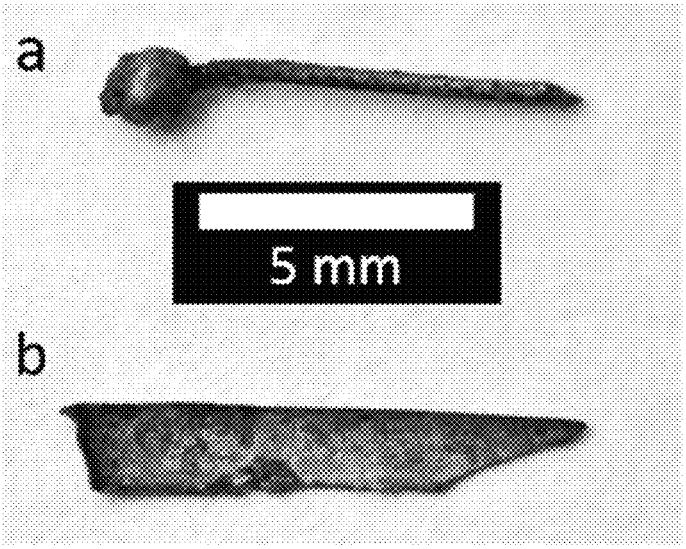
FIG. 13 is an image showing slag from a copper wire propellant grain (top) and Ni/Al foil propellant grain (bottom) collected post-burn.

Slag resulting from the copper wires (above) and Ni/Al foils (below) are represented in FIG. 13. No slag was collected from the propellant grains with Pyrofuze® wire, but may be expected to be produced as combustion of the wire at 1 atm yielded spherical products of about 1 mm in diameter. Very occasionally, similarly sized spheres were seen embedded in the char covering the propellant window, but were not collected. From this point of view, the Pyrofuze® wire may have benefits relative to the copper wires or the Ni/Al foils in fielded propellants as the condensed phase products are expected to be smaller, though slag size is dependent in part on the amount of material used. No slag was observed for the Al/PTFE propellant grains.

In theory, the bulk propellant burning rate should only change in the area immediately surrounding the metallic fiber. To verify this assertion in the composite propellant environment, the lateral burning rate of the propellants after ignition was measured. In general, the bulk propellant burning rate did not significantly change after ignition. However, the bulk propellant burning rate of the grain having an embedded Pyrofuze® wire did change slightly (e.g., decreased) for unknown reasons.

While the invention has been described in terms of specific or particular embodiments and investigations, it should be apparent that alternatives could be adopted by one skilled in the art. For example, the propellant and its components could differ in appearance and construction from the embodiments described herein and shown in the drawings, the components of the reactive accelerator may differ from the nonlimiting examples described herein, and various materials could be used in the manufacturing of the propellant and its components. Accordingly, it should be understood that the invention is not necessarily limited to any embodiment described herein or illustrated in the drawings. It should also be understood that the phraseology and terminology employed above are for the purpose of describing the disclosed embodiments and investigations, and do not necessarily serve as limitations to the scope of the invention. Therefore, the scope of the invention is to be limited only by the following claims.

The invention claimed is:

1. A body having a bulk axis and comprising a solid energetic material and a reactive burning rate accelerator material at least partially embedded in and contacting the solid energetic material, the reactive burning rate accelerator material comprising at least one metallic component and at least one non-metallic component that are combined to form the reactive burning rate accelerator material and exothermally self-react to exothermically generate heat, wherein the reactive burning rate accelerator material is embedded in the solid energetic material as at least one foil or strand that extends within the solid energetic material in a bulk axial direction of the body so as to ignite and combust to increase the mass burning rate of the solid energetic material and so that combustion of the reactive burning rate accelerator material causes the solid energetic material to regress away from the at least one foil or strand and in the bulk axial direction of the body to create a continuous cone-shaped void within the solid energetic material that extends in the bulk axial direction of the body.

2. The body of claim 1, wherein the body is chosen from the group consisting of explosives, propellants, pyrotechnics, and fuels, the body further comprises an oxidizer and a binder that bonds the solid energetic material, the oxidizer, and the reactive burning rate accelerator material, and the reactive burning rate accelerator material combusts without an external oxidizer to produce a gas.

3. The body of claim 1, wherein the reactive burning rate accelerator material is a mechanically-activated material and the at least one foil or strand is at least partially formed of micron-sized particles comprising nano-thickness layers of the at least one metallic component and the at least one non-metallic component.

4. The body of claim 3, wherein the at least one metallic component comprises aluminum and the at least one non-metallic component comprises polytetrafluoroethylene.

5. The body of claim 1, wherein the at least one foil or strand of the reactive burning rate accelerator material consists essentially of micron-sized particles comprising nano-thickness layers of the at least one metallic component and the at least one non-metallic component, wherein the at least one metallic component is aluminum and the at least one non-metallic component is polytetrafluoroethylene.

6. The body of claim 1, wherein the at least one metallic component comprises aluminum and the at least one non-metallic component comprises poly(carbon monofluoride).

7. The body of claim 1, wherein the at least one foil or strand of the reactive burning rate accelerator material consists essentially of micron-sized particles comprising nano-thickness layers of the at least one metallic component and the at least one non-metallic component, wherein the at least one metallic component is aluminum and the at least one non-metallic component is poly(carbon monofluoride).

8. The body of claim 1, wherein the reactive burning rate accelerator material comprises 50 to 90 wt. % of the at least one metallic component and 10 to 50 wt. % of the at least one non-metallic component.

9. The body of claim 1, wherein the reactive burning rate accelerator material comprises 70 to 90 wt. % of the at least one metallic component and 10 to 30 wt. % of the at least one non-metallic component.

10. A body having a bulk axis and comprising a solid energetic material and a reactive burning rate accelerator material at least partially embedded in and contacting the solid energetic material, the reactive burning rate accelerator material comprising a mechanically-activated material that is at least partially formed of micron-sized particles comprising nano-thickness layers of at least one metallic component and at least one non-metallic component that exothermally self-react to exothermically generate heat, wherein the reactive burning rate accelerator material is embedded in the solid energetic material as at least one foil or strand that extends within the solid energetic material in a bulk axial direction of the body so as to ignite and combust to increase the mass burning rate of the solid energetic material and so that combustion of the reactive burning rate accelerator material causes the solid energetic material to regress away from the at least one foil or strand and in the bulk axial direction of the body to create a continuous cone-shaped void within the solid energetic material that extends in the bulk axial direction of the body.

11. The body of claim 10, wherein the body is chosen from the group consisting of explosives, propellants, pyrotechnics, and fuels, the body further comprises an oxidizer and a binder that bonds the solid energetic material, the oxidizer, and the reactive burning rate accelerator material, and the reactive burning rate accelerator material combusts without an external oxidizer to produce a gas.

12. The body of claim 10, wherein the at least one foil or strand of the reactive burning rate accelerator material consists essentially of the micron-sized particles, wherein the at least one metallic component is aluminum and the at least one non-metallic component is polytetrafluoroethylene.

13. The body of claim 10, wherein the at least one foil or strand of the reactive burning rate accelerator material consists essentially of the micron-sized particles, wherein the at least one metallic component is aluminum and the at least one non-metallic component is poly(carbon monofluoride).

14. The body of claim 10, wherein the reactive burning rate accelerator material comprises 50 to 90 wt. % of the at least one metallic component and 10 to 50 wt. % of the at least one non-metallic component.

15. The body of claim 10, wherein the reactive burning rate accelerator material comprises 70 to 90 wt. % of the at least one metallic component and 10 to 30 wt. % of the at least one non-metallic component.

16. A method of manufacturing the body of claim 10, the method comprising casting the reactive burning rate accelerator material within the solid energetic material.

17. A method of manufacturing the body of claim 10, the method comprising using a three-dimensional (3-D) printing process to insert the reactive burning rate accelerator material into the body.

* * * * *